United States Patent [19]

Peets

[11] 4,126,363

[45] Nov. 21, 1978

[54] FOLDING SEWING MACHINE CABINET WITH STORAGE COMPARTMENT

[75] Inventor: Robert S. Peets, Watchung, N.J.

[73] Assignee: The Singer Company, New York, N.Y.

[21] Appl. No.: 856,442

[22] Filed: Dec. 1, 1977

[51] Int. Cl.[2] ..... D05B 75/00

[52] U.S. Cl. ..... 312/21; 312/30; 312/258; 108/113

[58] Field of Search ..... 312/21, 22, 27, 30, 312/237, 258, 104.2; 108/113

[56] References Cited

U.S. PATENT DOCUMENTS

| | | | |
|---|---|---|---|
| 232,127 | 9/1880 | Hicks | 312/258 |
| 1,015,430 | 1/1912 | Farmer | 312/258 |
| 1,670,026 | 5/1928 | Delano | 312/258 |
| 2,475,513 | 7/1949 | Peckinpaugh | 312/258 |
| 2,764,462 | 9/1956 | McDonald | 312/140.2 |
| 3,208,807 | 9/1965 | Becker | 312/140.2 |
| 3,253,870 | 5/1966 | Stanton et al. | 312/30 |
| 3,520,115 | 7/1970 | Bowen | 312/258 |

OTHER PUBLICATIONS

Giussani Santino S. N. C., Submitted as Prior Art by Applicant on Dec. 1, 1977.

*Primary Examiner*—Victor N. Sakran

*Attorney, Agent, or Firm*—Robert E. Smith; Edward L. Bell; Edward W. Goodman

[57] ABSTRACT

A sewing machine cabinet is disclosed having removable legs and fold-in sides thereby minimizing the amount of storage space required. This cabinet has the added feature of a built-in, rigid, folding storage compartment. The compartment includes two panels pivotably mounted one to the other and one to the cabinet whereby the two panels, along with the cabinet top and three adjoining sides, enclose an area beneath the cabinet top in which various articles appurtenant to sewing may be stored.

3 Claims, 5 Drawing Figures

FOLDING SEWING MACHINE CABINET WITH STORAGE COMPARTMENT

BACKGROUND OF THE INVENTION

In general, sewing machine cabinets are very bulky and cumbersome for the manufacturer who must arrange for shipment, the supplier who must allocate significant stock room or warehouse space for the inventory thereof, and the customer who prefers to carry the cabinet home. All in all, there is much demand for a sewing machine cabinet which may be assembled and disassembled with a minimum of effort.

Along with the desirability of a cabinet which may be dismantled easily, it is also desirable to provide the cabinet with a compartment for storing various articles needed while sewing, for example, thread, scissors, etc. While such compartments are well known in cabinets not designed to be dismantled, prior art cabinets with any folding or demountable feature have included, at the most, a leatherette or cloth-like pouch. However, such pouches are subject to being cut or torn.

SUMMARY OF THE INVENTION

The object of this invention is to provide a sewing machine cabinet capable of being easily dismantled. This object is achieved by pivotally mounting the sides of the cabinet to the cabinet top and removably attaching the legs thereto.

A further object of this invention is to provide a folding sewing machine cabinet with a built-in rigid storage compartment. This storage compartment is nested along one side of the cabinet whereby two panels each pivotally mounted to the other and to the cabinet will enclose an area excessible through an opening in the top of the cabinet.

DESCRIPTION OF THE DRAWINGS

With the above and additional objects and advantages in view as will hereinafter appear, this invention will be described with reference to the drawings of the preferred embodiment in which.

DESCRIPTION OF THE PREFERRED EMBODIMENT

Figure 1:
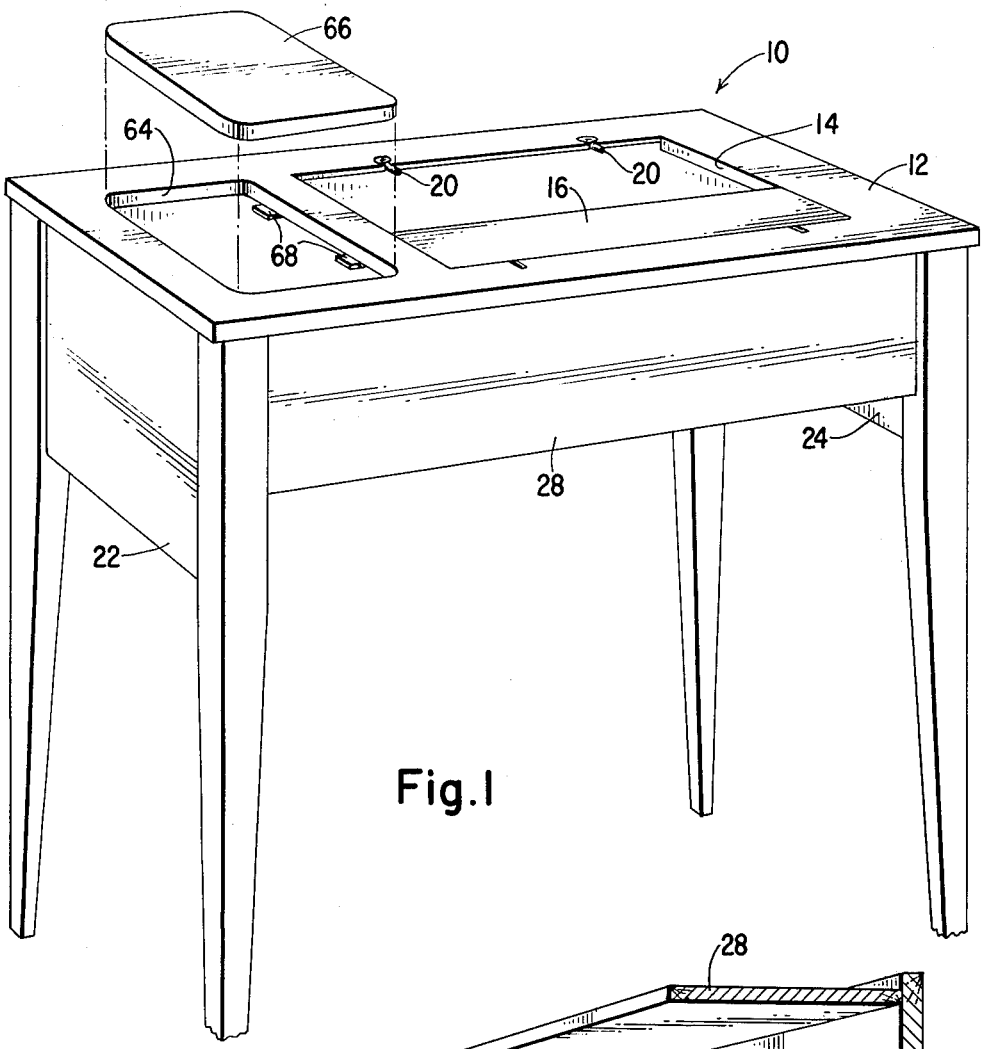
FIG. 1 is a perspective view of a folding sewing machine cabinet having the cover for a built-in storage compartment removed.
Figure 2:
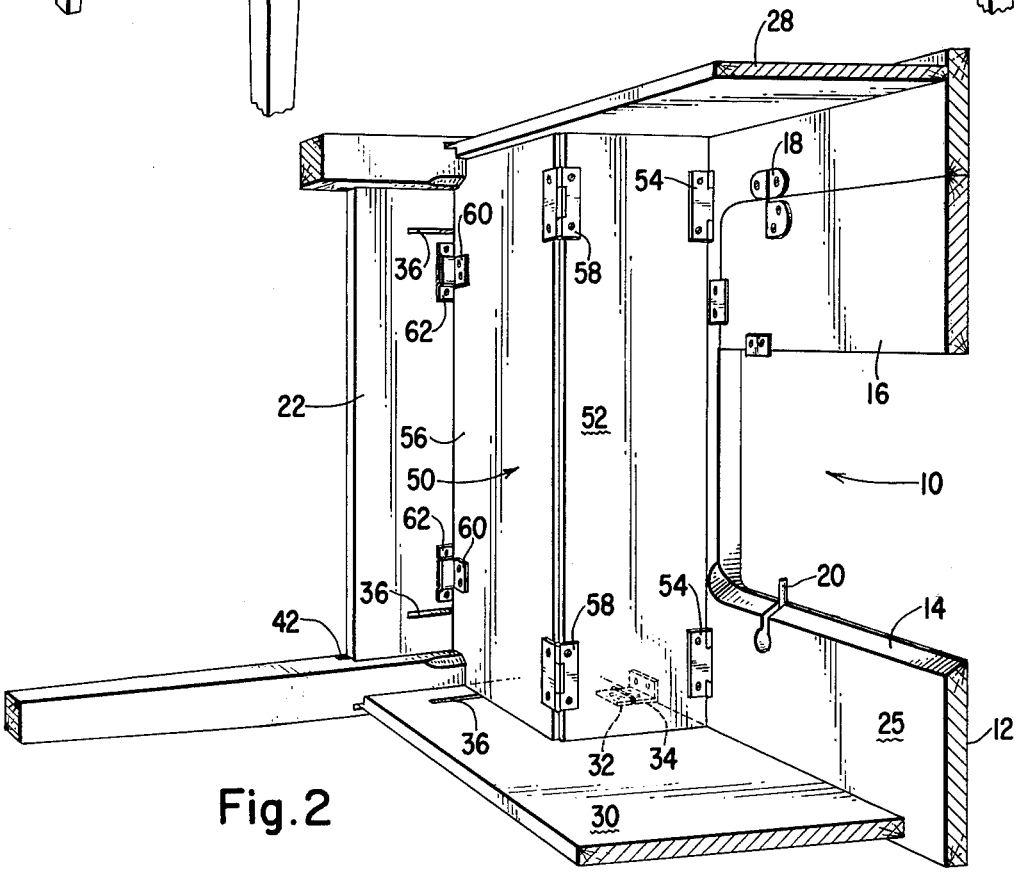
FIG. 2 is a perspective view of the underside of the folding sewing machine cabinet showing the folding storage compartment in an assembled state.

Referring to the drawings, a folding sewing machine cabinet is indicated generally by the number 10. The sewing machine cabinet 10 includes a flat top section 12, having a centrally located opening 14 therein for accommodating a sewing machine (not shown). The opening 14 is partially closed by a flap 16 which is pivotally mounted to the top section 12 by hinges 18, allowing the flap 16 to pivot upwardly. Mounting brackets 20 are attached to the top section 12 at the front of opening 14 to which a sewing machine may be pivotally mounted.

A left side 22 and a right side 24 are pivotally mounted to the mounting surface 25 of the top section 12 at opposite ends thereof using hinges 26. The axes of hinges 26 lie substantially along the intersections of the inside surfaces of the left and right sides, 22 and 24 respectively, with the surface 25 of the top section 12 so that when the sides 22 and 24 are folded in, a gap 23, equivalent to the thickness of the hinges 26, will be left between the sides 22 and 24 and the surface 25. A front and a rear panel, 28 and 30 respectively, are pivotally mounted to the surface 25 of the top section 12 along the front and rear edges thereof. Hinges 32, used to mount the front panel 28 and the rear panel 30, are specially formed having L-shaped portions 34 for mounting to the top section 12. The L-shaped portions 34 space the axes of the hinges 32 beneath the surface 25 of the top section 12 an amount sufficient to allow the front and rear panels, 28 and 30, to be folded flush beneath the left and right sides, 22 and 24, after the sides 22 and 24 have been folded in (see FIG. 4).

Figure 3:
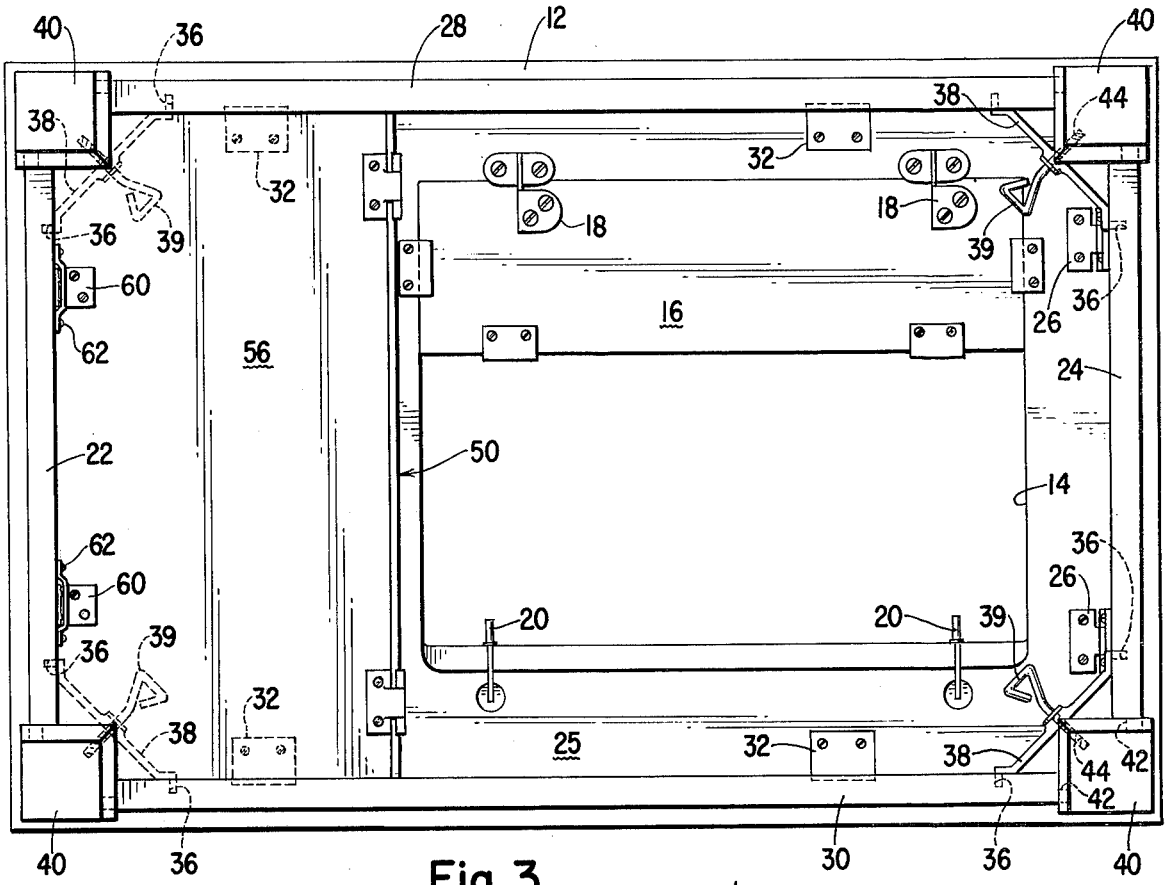
FIG. 3 is a plan view of the bottom of the sewing machine cabinet as in FIG. 2.

Grooves 36 are formed near the vertical edges on the inside of each of the left and right sides, 22 and 24, and the front and rear panels, 28 and 30. The grooves 36 accommodate diagonally situated mounting brackets 38 through which threaded studs 39 pass for fastening the legs 40 to the cabinet 10. Each leg 40 is formed with a groove 42 in each of two adjoining faces thereof and a tapped hole 44 entering each leg 40 at the interface of the adjoining faces bearing the grooves 42. When the legs 40 are fitted to the cabinet 10, the edges of the sides, 22 and 24, and the panels, 28 and 30, engage the grooves 42 and the studs 39 may be threaded into the tapped holes 44 (see FIG. 3).

Included in the cabinet 10 is a rigid folding storage compartment 50. The storage compartment 50 includes a first panel 52 pivotally mounted to the surface 25 of the top section 12 by means of hinges 54. A second panel 56 is pivotally mounted to the first panel 52 by hinges 58. Latches 60 are provided along the edge of the second panel 56 for engaging brackets 62 mounted on the inside of the left side 22. The first panel 52 and the second panel 56 extend the full width of the cabinet 10 thereby enabling the front panel 28 and the rear panel 30, along with the left side 22 and the top section 12, to be used to close the storage compartment 50. For accessing the storage compartment 50, an opening 64 preferably congruent with the compartment is formed in the top section 12. A cover 66 is provided to fit in the opening 64 and is retained by stops 68.

Figure 4:
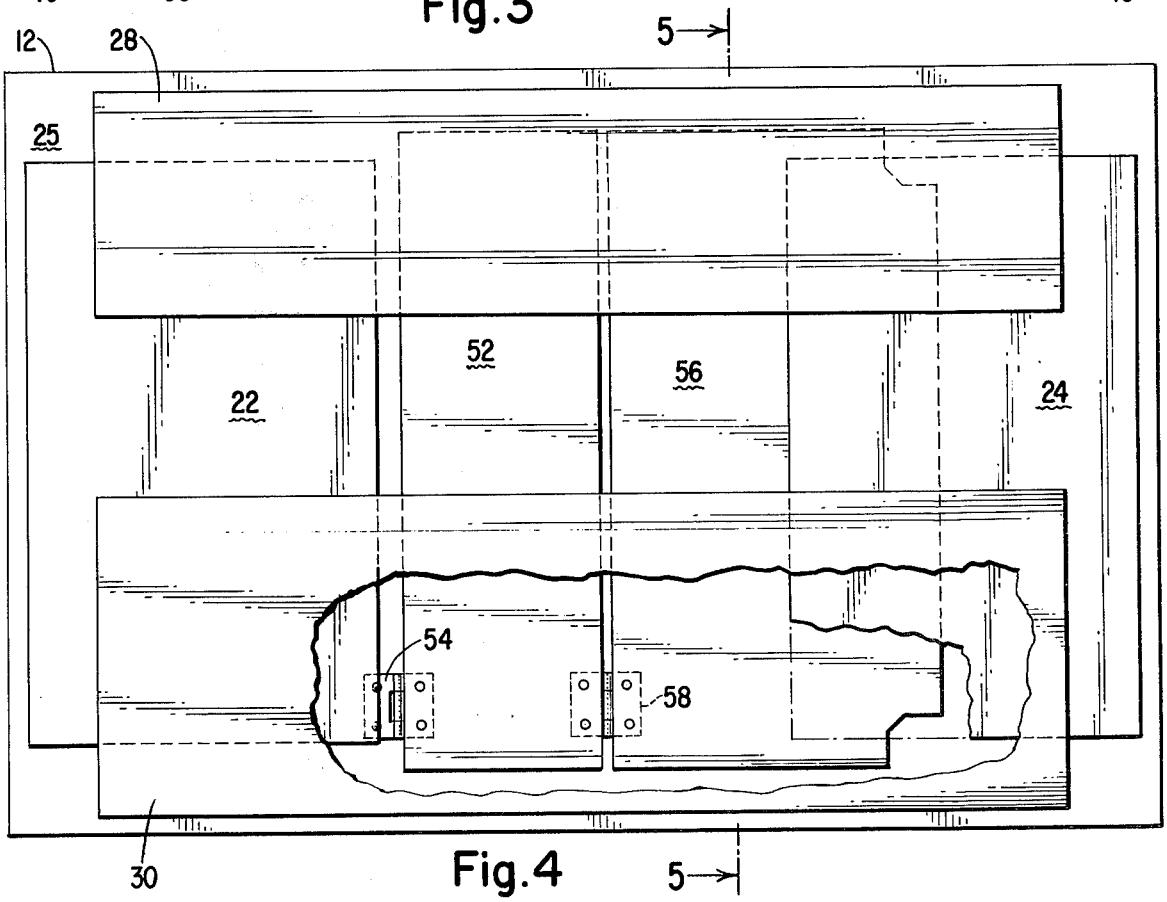
FIG. 4 is a plan view, partly in section, of the sewing machine cabinet in a completely folded state. The legs and the mounting hardware therefor have been excluded for clarity.
Figure 5:
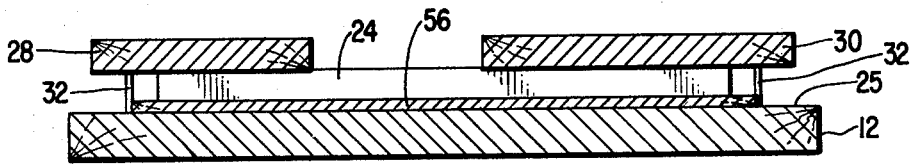
FIG. 5 is a cross-sectional view of the sewing machine cabinet taken along the line 5—5 of FIG. 4 showing the different parts of the cabinet in a folded relation.

To dismantle the cabinet 10 for storage, the latches 60 on the second panel 56 are disengaged from the brackets 62 on the left side 22. The compartment panels 52 and 56 are then unfolded to a flat position flush against the surface 25 of the top section 12 as shown in FIG. 4. Next, the studs 39 are unthreaded from the legs 40 and removed along with brackets 38. The legs 40 may now be removed from the cabinet 10. All that remains to be done is to first fold in the left side 22 and the right side 24 flush against the compartment panels 52 and 56 and then fold in the front panel 28 and the rear panel 30 flush beneath the sides 22, 24 and the compartment panels 52 and 56.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is herein claimed is:

1. A sewing machine cabinet comprising a substantially planar table top having as a mounting surface the underside thereof;

four sides, two opposite ones of said sides pivotally mounted to the table top mounting surface to fold beneath the table top leaving a gap between the mounting surface and said two opposite ones of said sides in the folded position, and two remaining sides also pivotally mounted to the table top mounting surface by hinges having axes arranged at a level beneath the mounting surface at least equal to the thickness of the first mentioned two opposite sides, so as to allow said two remaining sides to fold flush against the first mentioned two opposite sides when in the folded position; and articulated panels at least one of which is mounted to the table top mounting surface, said panels defining with one or more of said table top sides a rigid storage compartment, and said panels being foldable into the space defined by said gap between the first mentioned two opposite ones of said sides, the mounting surface of the table top, and the thickness of said first mentioned two opposite sides.

2. A sewing machine cabinet as set forth in claim 1 wherein two storage compartment defining panels are provided pivotally mounted one to the other, one of said panels also being pivotally mounted to the table top mounting surface within said gap, and means on the other of said panels for selective attachment to one of said cabinet sides whereby said one cabinet side, the two adjoining cabinet sides, the table top, and the two panels each define one plane face of a polyhedral-shaped storage compartment.

3. A sewing machine cabinet as set forth in claim 2 wherein one of the panels defining a plane face of said polyhedral-shaped storage compartment is formed with an access opening to said storage compartment.

* * * * *